US005582484A

United States Patent [19]

Asa

[11] Patent Number: 5,582,484

[45] Date of Patent: Dec. 10, 1996

[54] METHOD OF, AND APPARATUS FOR, AGITATING TREATMENT LIQUID

[75] Inventor: Takeshi Asa, Osaka, Japan

[73] Assignee: Tokushu Kika Kogyo Kabushiki Kaisha, Osaka, Japan

[21] Appl. No.: 512,638

[22] Filed: Aug. 8, 1995

[30] Foreign Application Priority Data

Jul. 10, 1995 [JP] Japan ..... 7-173382

[51] Int. Cl.[6] ..... B01F 15/06; B01F 9/10

[52] U.S. Cl. ..... 366/149; 366/279

[58] Field of Search ..... 366/279, 149, 366/302, 303, 307, 325.1, 325.2, 325.5, 144

[56] References Cited

U.S. PATENT DOCUMENTS

| | | | |
|---|---|---|---|
| 3,162,338 | 12/1964 | Grubelic | 366/347 |
| 4,114,522 | 9/1978 | Nagamine | 366/149 |
| 4,349,455 | 9/1982 | Yamamura | 252/312 |
| 4,647,213 | 3/1987 | Hay | 366/347 |

FOREIGN PATENT DOCUMENTS

| | | |
|---|---|---|
| 0124878 | 11/1984 | European Pat. Off. . |
| 62-45330 | 2/1987 | Japan . |
| 5-20426 | 5/1993 | Japan . |
| 6-7913 | 2/1994 | Japan . |

OTHER PUBLICATIONS

Patent Abstracts of Japan; vol. 14; No. 250 (C–723) [4193] dated May 29, 1990.

Patent Abstracts of Japan; vol. 14; No. 192 (C–711) [4135] dated Apr. 19, 1990.

Patent Abstracts of Japan; vol. 6; No. 135 (C–115) [1013] dated Jul. 22, 1982.

European Search Report dated Oct. 23, 1995; Ref. No: Me/kb; citing above listed references.

*Primary Examiner*—Robert W. Jenkins

*Attorney, Agent, or Firm*—Armstrong, Westerman, Hattori, McLeland & Naughton

[57] ABSTRACT

An apparatus for agitating a treatment liquid has a vessel for containing therein the treatment liquid. A turbine is rotatably provided inside the vessel. The turbine has a radius which extends close to an internal surface of the vessel. The turbine is rotated at a peripheral velocity of above about 20 m/sec by an electric motor. A flow cutoff ring is disposed along the internal surface of the vessel in a position above the turbine. When the treatment liquid is rotated by the turbine at a high speed, the treatment liquid is brought into a close contact with an internal surface of the vessel in a shape of a substantially hollow cylindrical film.

13 Claims, 5 Drawing Sheets

METHOD OF, AND APPARATUS FOR, AGITATING TREATMENT LIQUID

BACKGROUND OF THE INVENTION

1. Field of the Invention

The present invention relates to a method of, and an apparatus for, agitating a treatment liquid in which the treatment liquid (in this specification, the treatment liquid means a liquid to be treated or processed) which is made up of a combination of a liquid and a liquid, or a liquid and a powdery material is extremely finely pulverized for dispersion and emulsification.

2. Description of Related Art

In a conventional agitating apparatus, there is provided a turbine (or a turbine wheel or agitating blades) in the center of an agitating vessel, and a treatment liquid is agitated by the turbine for further pulverization. FIGS. 5A and 5B represent examples of conventional apparatuses. In the example shown in FIG. 5A, there is provided a shaft b so as to extend into a vessel "a" and a turbine c of a smaller diameter is attached to the shaft b. The shaft b is rotated to agitate the treatment liquid d. It is thus so arranged that the treatment liquid d is sheared and dispersed by the turbine c and, at the same time, a circulation in the outward direction as shown by arrows is caused to occur in the upper and the lower portions of the turbine to thereby agitate the treatment liquid d. In order to prevent the treatment liquid from circulating without agitation, a stator f in the form of a rib is provided inside the vessel "a". In this apparatus the diameter $D_1$ of the turbine c is relatively far smaller than the internal diameter D of the vessel "a", and is generally below one-fifth of the internal diameter D. In this Figure, reference character $a_1$ denotes a jacket or sleeve to flow therethrough a medium for heat-exchanging purpose, i.e., for heating or cooling the treatment liquid d.

In the example shown in FIG. 5B, there is used an inclined turbine $c_1$ as the turbine, and stators $f_1$ are supported by means of fixing members g. This apparatus corresponds to the one as disclosed in Japanese Published Examined Patent Application No. 7913/1994. The shaft b is driven at a high speed to rotate the turbine $c_1$ at a peripheral velocity of about 15 m/sec. It is thus so arranged that, aside from the shearing effect, cavitation is positively caused to occur on the rear surface of the turbine $c_1$ to thereby accelerate the pulverization. The treatment liquid d near the turbine $c_1$ is circulated in the direction as shown by arrows $e_1$.

This kind of conventional apparatuses have the following disadvantages.

1) The treatment liquid d which is subject to the function of the turbine c, $c_1$ is limited to that which is present in the neighborhood of the turbine c, $c_1$. Although the function of the turbine c, $c_1$ is equalized by the circulation of the treatment liquid d as shown by the arrows e, $e_1$, it is necessary to increase the number of circulation in order to treat the entire treatment liquid d, with the result that the time required for treatment becomes long.

2) Rotation of the treatment liquid d together with the turbine c, $c_1$ reduces the agitating effect. As a solution, stator(s) f, $f_1$ must be provided as shown in FIGS. 5A and 5B.

3) If the turbine c, $c_1$ is rotated at a high speed in order to give a higher energy to the treatment liquid d, there occurs a slipping phenomenon accompanied by cavitation when a certain speed of rotation has reached. In particular, when a liquid of high viscosity is to be agitated, the agitation effect is extremely reduced due to the above-described slipping phenomenon.

4) There are many occasions in which, during the processing work, the treatment liquid d is agitated, charged, or discharged while the treatment liquid d is heated or cooled by flowing a medium for heat exchanging through the jacket $a_1$. However, since the overall speed of circulation of the treatment liquid is low, the temperature distribution inside the vessel "a" becomes uneven, with the result that the agitation by the turbine c, $c_1$ at a uniform temperature is difficult.

In order to improve the above-described conditions, there has been used an apparatus in which auxiliary devices such as an agitator, a scraper, or the like are added. However, the above-described arrangement results in a complicated mechanism, and a satisfactory effect cannot be obtained.

As a further disadvantage of the conventional apparatus, the following can also be pointed out.

5) Agitation to attain the pulverization, dispersion, and emulsification of a high order cannot be performed by the change in the shape of the turbine or by the addition of the above-described auxiliary devices. Such an arrangement does contrarily increase the amount of adhesion of the treatment liquid to various portions of the apparatus, resulting in a smaller yield. Further, the turbine c, $c_1$ must be set to an appropriate height because the circulation of the entire treatment liquid becomes poor if the turbine c, $c_1$ is positioned too close to the bottom of the vessel "a". Then, the minimum amount of treatment liquid cannot be decreased, resulting in a poor payability or poor economy. Further, if the agitator, the scraper or the like are added, the structure becomes complicated and the ease with which the apparatus can be flushed or cleaned becomes poor.

The present invention has an object of providing a method of, and an apparatus for, agitating a treatment liquid which solve the disadvantages mentioned in the above items 1) through 5).

SUMMARY OF THE INVENTION

In order to attain the above and other objects, according to one aspect of the present invention, there is provided a method of agitating a treatment liquid comprising rotating agitating means inside a vessel at a speed sufficient to impart a rotational movement to the treatment liquid such that by a centrifugal force the treatment liquid is brought into a close contact with an internal surface of the vessel in a shape of a substantially hollow cylindrical film and agitating, during the rotational movement, the hollow cylindrical film of the treatment liquid by tip portions of the agitating means.

Preferably, the agitating means is rotated at a peripheral velocity of above about 20 m/sec.

According to the above-described method, the treatment liquid is rotated at a high speed by receiving the energy of the agitating means and is rotated by a centrifugal force while adhering to the internal surface of the vessel in the shape of a thin film of a substantially hollow cylinder. The speed of rotation of the treatment liquid is however smaller than that of the agitating means. Therefore, the treatment liquid to pass through the agitating means is surely subject to an agitating function or operation by tip portions or outer end portions of the agitating means and is finely pulverized by the agitating function to be generated as a result of the rotation of the flow of the treatment liquid.

According to another aspect of the present invention, there is provided an apparatus for agitating a treatment liquid comprising: a vessel for containing therein a treatment liquid; agitating means rotatably provided inside the vessel, the agitating means having a radius extending close to an internal surface of the vessel; and driving means for rotating the agitating means.

Preferably, the agitating means is rotated at a speed sufficient to impart a rotational movement to the treatment liquid such that by a centrifugal force the treatment liquid is brought into a close contact with an internal surface of the vessel in a shape of a substantially hollow cylindrical film, and the radius of the agitating means is such that the treatment liquid of the shape of the substantially hollow cylindrical film is agitated by tip portions of the agitating means. The speed sufficient to impart a rotational movement to the treatment liquid is a peripheral velocity of above about 20 m/sec.

The apparatus preferably further comprises a flow cutoff ring (i.e., a ring to partially disturb the axial flow of the treatment liquid) disposed along the internal surface of the vessel so as to extend inwards of the internal surface of the vessel. The flow cutoff ring is positioned above the agitating means.

The agitating means may comprise a turbine having projections which are provided on an outer end portions of the turbine in a manner to extend substantially in upward and downward directions. The agitating means may also comprise a wire wheel.

The apparatus may further comprise a jacket provided along an external surface of the vessel for flowing the medium for heat exchanging purpose.

In still another preferred embodiment of the present invention, an internal surface of the vessel is formed in a stepped manner into at least two different internal diameters, and the agitating means is arranged to be movable along an axial line of the vessel.

The apparatus may further comprise projections which are provided on at least a part of the internal surface of the vessel so as to lie within a limit which falls outside the external diameter of the agitating means.

According to the above-described apparatus, the end portion of the agitating means is extended close to the internal surface of the vessel. When a treatment liquid which is relatively smaller in quantity than the volume of the vessel is charged into the vessel and the agitating means is rotated at a high speed of rotation, the treatment liquid is rotated substantially in the form of a hollow cylindrical thin film along the internal surface of the vessel. The treatment liquid is thus agitated as a result of the difference between the speed of rotation of the agitating means and that of the treatment liquid, and agitating function occurs due to the rotational flow of the treatment liquid, thereby causing fine pulverization.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF PREFERRED EMBODIMENTS

Figure 1:
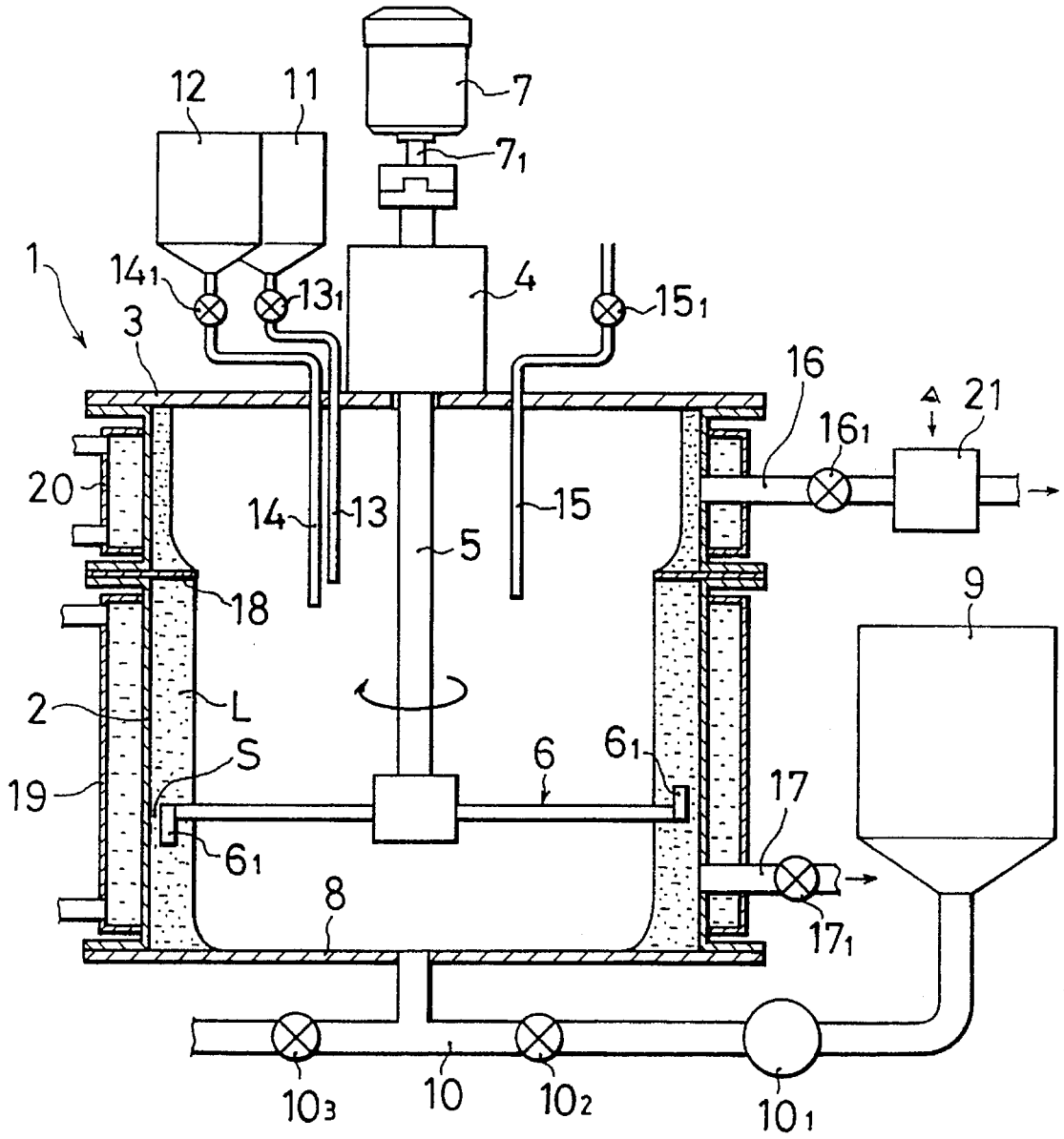
FIG. 1 is a vertical sectional view of one embodying example of the present invention.

Preferred embodiments of the present invention will now be explained with reference to the accompanying drawings. In FIG. 1 numeral 1 denotes a high-speed agitating apparatus of the present invention, numeral 2 denotes a vessel and numeral 3 denotes a cover to the vessel 2. A bearing 4 is fixed to the cover 3 to support a shaft 5. On a lower end of the shaft 5 there is attached a turbine 6 which serves as an agitating means (In this specification, the term turbine is used in a sense of a turbine wheel or agitating blades). On an outer end of the turbine 6, there are attached projecting pieces $\mathbf{6}_1$ in both upward and downward directions in order to improve the agitating function. There is secured only a very small clearance S between the outer end of the turbine 6 and the internal surface of the vessel 2. Numeral 7 denotes an electric motor which is mounted on a stationary support (not shown), and a shaft $\mathbf{7}_1$ of the electric motor 7 is connected to the shaft 5.

In the bottom portion 8 of the vessel 2 there is connected an inlet pipe 10 from a tank 9 which contains therein a liquid to be treated (treatment liquid) via a pump $\mathbf{10}_1$ and a valve 102. Another tank is connected via a valve 103. In the cover 3 there are provided, in a throughgoing manner, pipes 13, 14 which extend, via valves $\mathbf{13}_1$, $\mathbf{14}_1$, from tanks 11, 12 which contain therein additives. There is also provided in a throughgoing manner a vacuum pipe 15 which is connected to a vacuum source via a vacuum valve $\mathbf{15}_1$ so that the agitation can also be carried out under vacuum. On an upper side surface of the vessel 2 there is connected a discharge pipe 16 for discharging the treated liquid. On a lower side surface of the vessel 2 there is connected a lower discharge pipe 17. Numerals $\mathbf{16}_1$ and $\mathbf{17}_1$ are valves which are disposed in the discharge pipes, respectively. The discharge pipe 16 is used to discharge the treated liquid in a continuous treating or processing operation. The lower discharge pipe 17 is used for discharging the treated liquid in a batch processing operation or for discharging a flushing or cleaning liquid after cleaning the inside of the apparatus.

The vessel 2 has a cylindrical internal surface. Below the discharge pipe 16 there is provided flange-shaped flow cutoff ring 18 which projects inwards of the vessel 2. On an external surface of the vessel 2 there are provided jackets 19, 20 in order to flow a heat-exchanging medium for heating or cooling the treatment liquid. Numeral 21 denotes a particle size measuring device which is disposed in the discharge pipe 16 for observing the pulverized condition of the treated liquid.

In operation, the treatment liquid L is charged into the vessel 2 up to the neighborhood of the turbine 6. The turbine 6 is rotated at a high speed by the operation of the electric motor 7. The treatment liquid L is then rotated by receiving the energy of the turbine 6 and is forcibly pressurized by centrifugal force against the internal surface of the vessel 2. The treatment liquid L therefore increases in pressure and rotates in a shape of a substantially hollow cylindrical thin film. The rotation of the treatment liquid L occurs not only in the portion which comes into contact with the turbine 6 but also in a portion which is away from the turbine 6 as a consequence of the movement of the treatment liquid L to be rotated by the turbine 6. When there exists air inside the vessel 2, the rotation of the air is transmitted to the treatment liquid L for consequent rotation thereof. Here, since the speed of rotation of the turbine 6 is larger than the speed of rotation of the treatment liquid L and since the clearance S is small, the treatment liquid L that exists in the plane of rotation of the turbine 6 is all agitated by the turbine 6 to thereby cause the occurrence of a function of pulverization, dispersion, mixing, emulsification or the like of a high order.

The treatment liquid L that exists outside the plane of rotation of the turbine 6 is subject to a mixing function by the rotating movement due to the inertia of the treatment liquid itself.

The treatment liquid L in the shape of a substantially hollow cylindrical film is agitated while being restricted in rising or an upward movement by the flow cutoff ring 18. The treatment liquid L is always subject to a strong agitating effect by the tip or the front end portions of the turbine 6 while rising along the internal surface of the vessel 2 and is, therefore, sufficiently agitated at a short time. After passing through the flow cutoff ring 18, the treatment liquid L maintains the rotation and pressure, thereby being discharged out of the discharge pipe 16 by the pressure.

In the above-described agitating operation, the rising speed of the treatment liquid L along the internal surface of the vessel 2 is proportional to the incoming or inlet speed of the treatment liquid L through the inlet pipe 10. The amount of treatment liquid L to flow over the flow cutoff ring 18 is equal to the inlet amount of the treatment liquid L. Therefore, the rising speed or the retention time of the treatment liquid L can be adjusted by controlling the inlet speed by means of the pump $\mathbf{10}_2$ or the valve $\mathbf{10}_2$. Since, by this adjustment, the agitating energy to be imparted to the treatment liquid L can also be adjusted, it is easy to attain a desired agitating condition.

Figure 2:
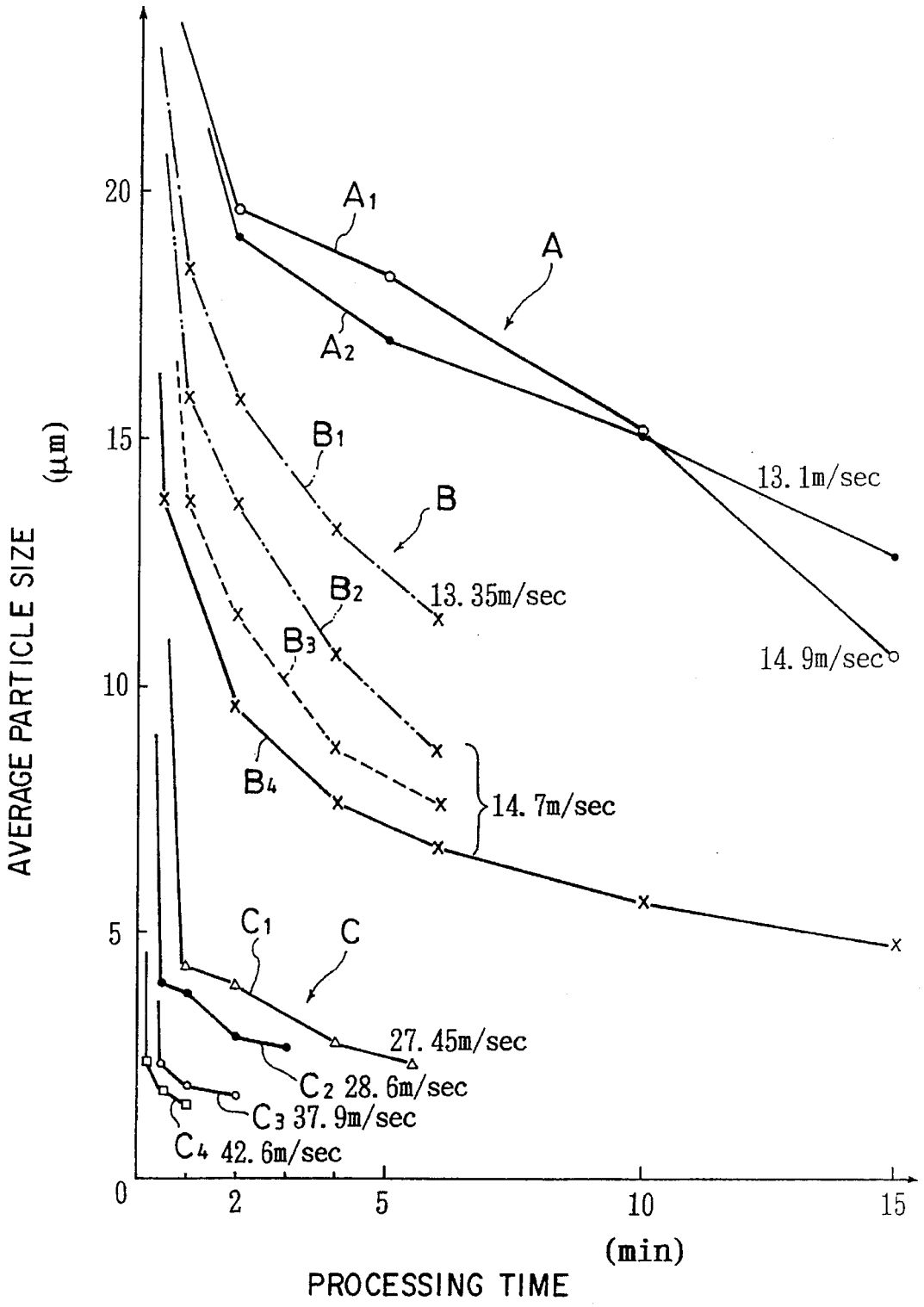
FIG. 2 is a diagram showing the relationship between the processing (agitating) time and the average particle size.

FIG. 2 shows the data on the agitating operation according to the conventional agitating apparatuses and the agitating apparatus of the present invention. The ordinate represents the average particle size (μm) and the abscissa represents the time of treatment or processing (min). As the treatment liquid, there was used one obtained by mixing water and paraffin in a mixing ratio of 4:1 and by adding 1% or less of a surface active agent. In this Figure, the curves belonging to the group marked A and the group marked B are the results of agitation by different types of conventional apparatuses. The curves belonging to the group marked C are the results of agitation by the apparatus of the present invention. The apparatuses which showed the data as represented by the curves $A_1$ through $B_4$ have the shape of the turbine, the radius of the turbine, the amount of treatment liquid or the like which are slightly different from apparatus to apparatus. The internal diameter of the vessel was all the same throughout the groups A, B and C, i.e., 156 mm. The diameter of the turbine in the group C was 152 mm. It follows that the clearance S between the internal surface of the vessel 2 and the end portion of the turbine 6 in the group C was 2 mm.

The speed given in each of the curves $A_1$ through $C_4$ represents the peripheral velocity of the turbine, which was 13.1 m/sec in curve $A_1$ and 14.9 mm in curve $A_2$. Since there was used in the group B a different apparatus from that in the group A, the peripheral velocity in the curve $B_1$ was 13.35 m/sec and 14.7 m/sec in the curves $B_2$, $B_3$ and $B_4$. These peripheral velocities were substantially the maximum value of the conventional apparatus.

On the other hand, the peripheral velocity of the turbine of the group C of the present invention was 27.45 m/sec in the curve $C_1$, 28.6 m/sec in the curve $C_2$, 37.9 m/sec in the curve $C_3$ and 42.6 m/sec in the curve $C_1$. The mixing conditions before starting the agitating operation were all the same in the curves $A_1$ through $C_4$.

The degree of fine pulverization of paraffin particles and the time required to attain that degree were as follows. Namely, 15 minutes was required in the group A to attain the particle sizes of 11 through 12.5 μm, 6 minutes was required in the group B to attain the particle sizes of 7 through 12 μm, and 15 minutes was required in the same group to attain 5 μm.

On the other hand, in the group C, only 4 minutes was required for the curve $C_1$ (or for the agitating operation as represented by the curve $C_1$) to attain the particle size of 3 μm and only 3 minutes was required for the curve $C_2$ to attain the same particle size. Only 0.5 minute was required for the curve $C_3$ to attain the particle size of 2.5 μm and only 0.2 minute was required for the curve $C_4$ to attain the same particle size. Only 2 minutes was required for the curve $C_3$ to attain the particle size of 1.7 μm and only 1 minute was required for the curve $C_4$ to attain the particle size of 1.5 μm.

As described hereinabove, as compared with the groups A and B by the conventional apparatuses, the degree of pulverization and the time required to attain it in the group C by the present invention was far superior. The reason for this superiority is considered to be due to the fact that the entire treatment liquid L is agitated by the high-speed outer end portions (or the tip portions) of the turbine in a condition of a hollow cylindrical thin film. According to the experiments, the effects of superior pulverization occurs at the peripheral velocities of the turbine in the neighborhood of 20 m/sec and are remarkable at the peripheral velocity above 30 m/sec. Since the treatment liquid L is in the form of a thin film at the time of agitation, the heat transfer from the heat-exchanging medium to the treatment liquid L can be made uniformly and quickly by the jackets 19, 20 in case heating or cooling of the treatment liquid L is carried out.

Though the time required for the group C to attain a pulverized condition is short, as compared with the groups A and B, the operating radius of the turbine is large and the peripheral velocity is high. Therefore, an electric motor which rotates at a high torque and a high speed of rotation is required, with a consequent large electric power input. Further, in the group C, as can be seen from the curves $C_1$ through $C_4$, the larger the peripheral velocity, the smaller the particle size. It follows that, by varying the peripheral velocity, the treated liquid having a desired particle size can be obtained.

The peripheral velocity of the agitating means in the conventional apparatus is normally up to about 20 m/sec. By using the apparatus of the present invention, however, the agitating work can be effectively carried out even if the peripheral velocity is further increased. In the above-described embodying examples, the maximum peripheral velocity was 42.6 m/sec. However, it can be increased to, for example, 100 m/sec or 200 m/sec, thereby agitating a treatment liquid in a shorter processing time down to ultrafine pulverization and emulsification.

Figure 4:
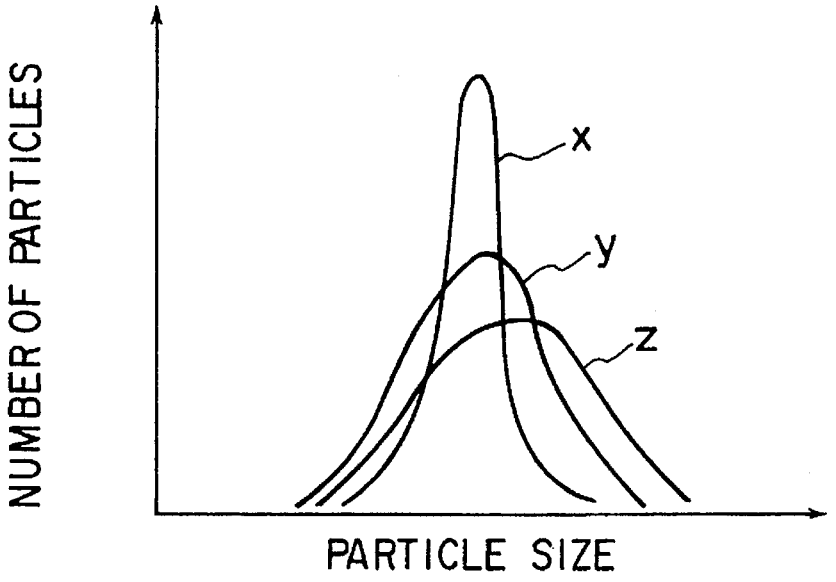
FIG. 4 is a diagram showing the relationship between the clearance between the vessel and the turbine and the particle size distribution.
Figure 5A:
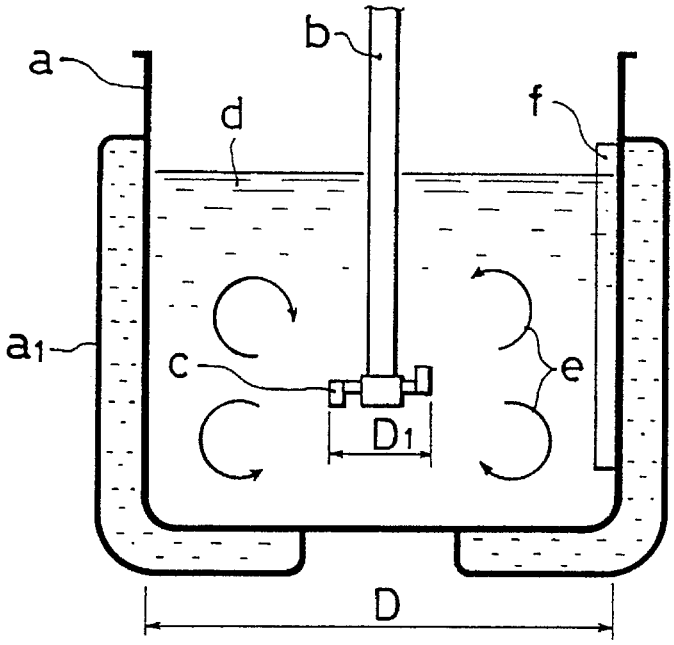
FIG. 5A PRIOR ART
FIGS. 5A and 5B are vertical sectional views of conventional apparatuses.
Figure 5B:
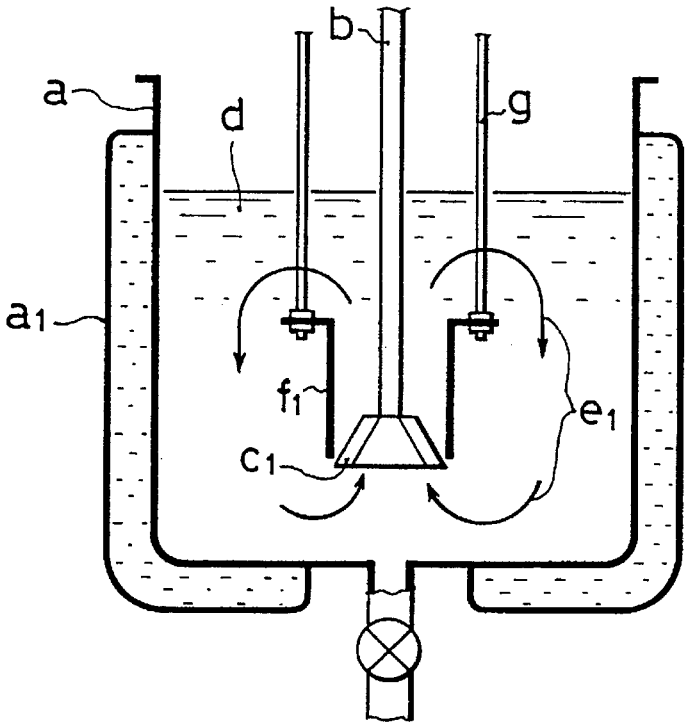
FIG. 5B PRIOR ART

The particle size distribution in the treatment liquid varies with the clearance S between the internal surface of the vessel 2 and the turbine 6. FIG. 4 shows the change in the particle size distribution with the change in the clearance S. The curve x shows the particle size distribution with a small clearance S, curve y with an intermediate clearance S, and curve z with a large clearance S. Therefore, by adjusting the peripheral velocity of the turbine 6 and the clearance S, an arbitrary particle size and the particle size distribution can be obtained. It follows that the processing to attain a pulverization of a high order and uniform particle size can be made easily.

Figure 3:
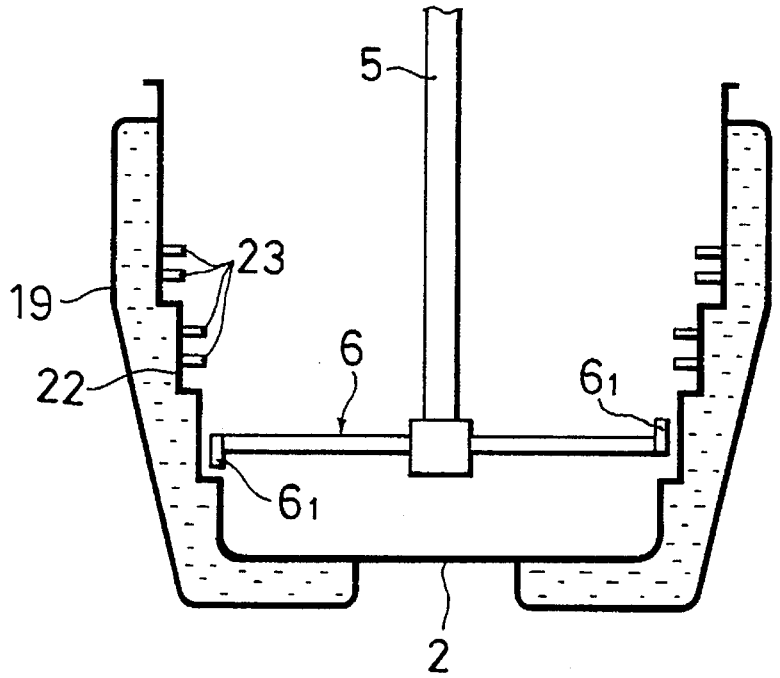
FIG. 3 is a partial sectional view of another embodying example of the vessel and other parts of the present invention.

In the above-described embodiment, the vessel 2 was of a simple cylindrical shape. However, it may be formed as shown in FIG. 3. Namely, the cylindrical body of the vessel 2 is formed in multi-stage diameters 22 such that the position of the turbine 6 in an axial direction of the vessel 2 (i.e., in the vertical direction in this Figure) may be varied depending on the desired particle size distribution or the viscosity of the treatment liquid.

Further, a plurality of projections 23 may also be provided on an internal surface of the vessel 2 so as to be located within a limit which falls outside the external diameter of the turbine 6. According to this arrangement, there is caused a resistance to the flow both in the circumferential and the axial directions. It is thus possible to increase the substantial number of agitation by the turbine 6. In the group C, a similar effect can also be obtained even in case the internal diameter of the vessel 2 and the external diameter of the turbine 6 are made larger than the above-described concrete figures.

Figure 6:
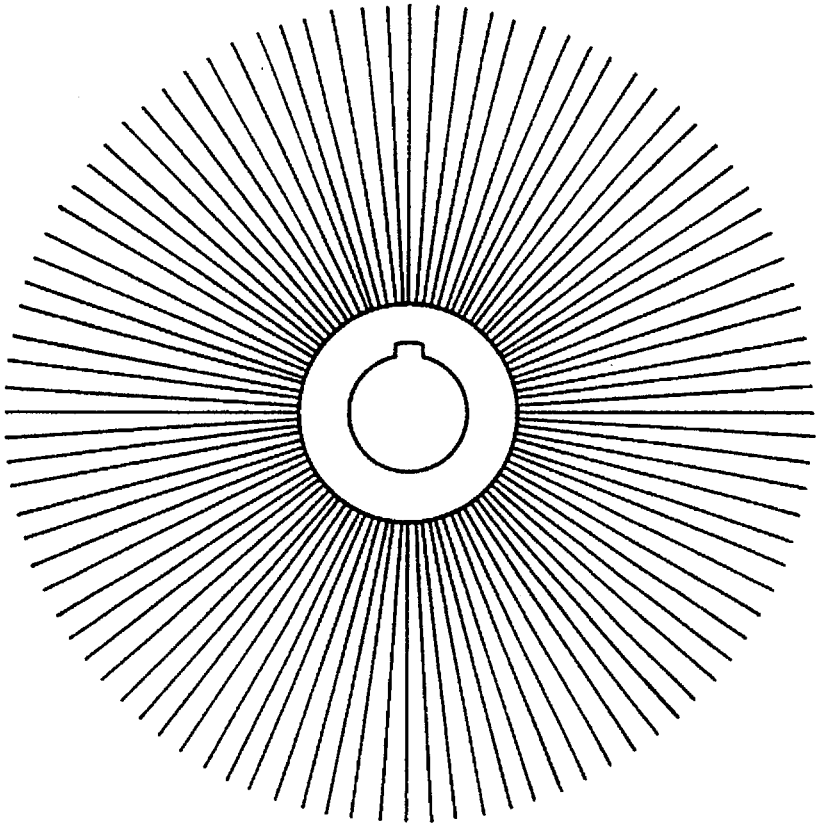
FIG. 6 is a view of a wire wheel.

Illustrated in FIG. 6, instead of the turbine 6 as shown in FIGS. 1 and 3, there may be used a wire wheel which is formed in substantially a disk whose outer periphery extends close to the internal surface of the vessel 2.

As has been described hereinabove, according to the method of the present invention, the particle size of the fine particles can be made below a fraction of the conventional size, and the time required for the processing can also be made below a fraction of the conventional time. It has therefore superior effects that cannot be anticipated by the conventional art. It has an advantage that the agitated product of superior quality can be made efficiently.

Further, since the treatment liquid is maintained in the shape of a thin film along the internal surface of the vessel, heat exchanging between the treatment liquid and a heat-exchange medium for heating or cooling to flow through the jackets can be made quickly and uniformly in case heating or cooling is made to the treatment liquid from outside the vessel.

According to the apparatus of the present invention, the effect according to the above method can be attained in a simpler construction because there is used no movable parts inside the vessel except for the turbine as an example of the agitating means. In this apparatus the portions to which the treatment liquid will be adhered are limited only to the vessel and the turbine. Therefore, the amount of treatment liquid to be discarded by flushing (or cleaning) is small and, consequently, the yield is good and the flushing work is easy.

It is readily apparent that the above-described method of, and an apparatus for, agitating a treatment liquid meet all of the objects mentioned above and also has the advantage of wide commercial utility. It should be noted that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of agitating a treatment liquid comprising rotating agitating means having tip portions inside a vessel at a speed sufficient to impart a rotational movement to the treatment liquid such that by a centrifugal force the treatment liquid is brought into a close contact with an internal surface of the vessel in a shape of a substantially hollow cylindrical film and agitating, during the rotational movement, the hollow cylindrical film of the treatment liquid by the tip portions of the agitating means.

2. A method of agitating a treatment liquid according to claim 1, wherein said speed sufficient to impart a rotational movement to the treatment liquid is a peripheral velocity of above about 20 m/sec.

3. An apparatus for agitating a treatment liquid comprising:

a vessel for containing therein a treatment liquid;

agitating means having tip portions, said agitating means being rotatably provided inside said vessel; and driving means for rotating said agitating means;

wherein said agitating means with a radius extending towards an internal surface of said vessel is rotated at a speed sufficient to impart a rotational movement to the treatment liquid such that by a centrifugal force the treatment liquid is brought into a close contact with the internal surface of the vessel in a shape of a substantially hollow cylindrical film and wherein the radius of the agitating means is such that the treatment liquid of the substantially hollow cylindrical film is agitated by the tip portions of said agitating means.

4. An apparatus for agitating a treatment liquid according to claim 3, wherein said speed sufficient to impart a rotational movement to the treatment liquid is a peripheral velocity of above about 20 m/sec.

5. An apparatus for agitating a treatment liquid according to claim 3, further comprising a flow cutoff ring disposed along the internal surface of said vessel so as to extend inwards of the internal surface of said vessel, said flow cutoff ring being positioned above said agitating means.

6. An apparatus for agitating a treatment liquid according to claim 3, wherein said agitating means comprises a turbine having projections which are provided on outer end portions of said turbine in a manner to extend substantially in upward and downward directions.

7. An apparatus for agitating a treatment liquid according to claim 3, wherein said agitating means comprises a wire wheel.

8. An apparatus for agitating a treatment liquid according to claim 3, further comprising a jacket provided along an external surface of said vessel for flowing therein a medium for heat-exchanging purpose.

9. An apparatus for agitating a treatment liquid according to claim 3, wherein an internal surface of said vessel is formed in a stepped manner into at least two different internal diameters, and wherein said agitating means is movable along an axial line of said vessel.

10. An apparatus for agitating a treatment liquid according to claim 9, further comprising projections provided on at least a part of said internal surface of said vessel so as to lie within a limit which falls outside the external diameter of said agitating means.

11. An apparatus for agitating a treatment liquid according to claim 9, further comprising a jacket provided along an external surface of said vessel for flowing therein a medium for heat-exchanging purpose.

12. An apparatus for agitating a treatment liquid according to claim 9, wherein said agitating means comprises a turbine having projections which are provided on outer end portions of said turbine in a manner to extend substantially in upward and downward directions.

13. An apparatus for agitating a treatment liquid according to claim 9, wherein said agitating means comprises a wire wheel.

* * * * *